United States Patent [19]

Stolzenberg

[11] 4,137,039

[45] Jan. 30, 1979

[54] MEANS FOR THE MEASUREMENT OF RELATIVE MOVEMENT BETWEEN LOOSE RACEWAYS AND A REVOLVING DRUM MOUNTED IN THE RACEWAYS

[75] Inventor: Heinz Stolzenberg, Burglengenfeld, Fed. Rep. of Germany

[73] Assignee: KHD Industrieanlagen AG, Fed. Rep. of Germany

[21] Appl. No.: 763,518

[22] Filed: Jan. 28, 1977

[51] Int. Cl.[2] ..... F27B 7/00; F27B 7/20

[52] U.S. Cl. ..... 432/103; 432/4

[58] Field of Search ..... 432/4, 103; 340/270; 235/132 R, 128

[56] References Cited

U.S. PATENT DOCUMENTS 3,165,171 1/1965 Baeriswyl ..... 235/132 R

*Primary Examiner*—John J. Camby

*Attorney, Agent, or Firm*—Staas & Halsey

[57] ABSTRACT

A process and apparatus for measuring relative movement between loose raceways and a revolving drum consisting of generating pulses for one or more revolutions of the raceways by a contactless pulse generator in the area between the motor and a gear input shaft and via contactless pulse generators on the raceways for one or more revolutions of the raceways, the difference of the pulses being determined with a predetermined constant value for the revolving drum and the difference being recalculated for the relative movement.

7 Claims, 2 Drawing Figures

MEANS FOR THE MEASUREMENT OF RELATIVE MOVEMENT BETWEEN LOOSE RACEWAYS AND A REVOLVING DRUM MOUNTED IN THE RACEWAYS

BACKGROUND AND SUMMARY OF THE INVENTION

The invention relates to a process for the measurement of the relative movement between loose raceways and a revolving drum mounted in the raceways which is driven by a motor.

For the mounting of revolving drums, raceways and rollers are used. Recently, so-called loose raceway constructions are used. In the case of these raceway constructions, a predetermined difference of diameter is required as a result of the mounting in order to be able to mount the rings on their seating surface. A slight clearance (play) must also exist in the operation in addition in the case of heated revolving tubes, in order that the ring may migrate towrd the revolving tube with a slight relative movement during standard operation. The clearance between the raceways and the furnace however must be kept as small as possible in order that a stronger fulling effect be avoided and that the ring increases the rigidity of the tubular drum. In the case of larger deformations of the tubular drum the insertions, in the case of fired revolving furnaces, the fire-resistant brick linings will be destroyed.

On the other hand however and particularly in the case of inside fired revolving furnaces, the play of the raceways must not be too small, since otherwise the revolving tube will be constricted below the stiffer raceways, which likewise could lead to destruction of the fire-resistant lining.

Furthermore, as a result of a too quick heating up process the raceways are not heated and expanded as quickly as the revolving tube, so that the latter becomes constricted. This likewise will lead to the above mentioned damage.

In order to avoid this type of damage, the relative play of the raceways in relation to the revolving tube is observed by individuals during the dangerous phase. It is possible only to control the starting phase, however. A continuous evaluation during the production phase is not possible, although even in the case of this operational phase constrictions may occur as a result of a sudden drop in clearance or damage to the brick lining.

Therefore, the present invention is directed towards a process of the initially mentioned type and an apparatus for this process which continuously determines the relative movement between the raceways and the revolving drum and which sounds an alarm in the case of danger.

The solution of this task consists in the fact that according to the present invention pulses are created on the raceways by way of a contactless pulse generator in the area of the motor shaft and of the gear input shaft and by way of contactless pulse generators on the raceways, the difference of the pulses being determined for a predetermined value for the rotary drum and for the effectively measured value in the case of one or several revolutions of the raceways and the difference being recalculated for the relative movement. The number of pulses emanating from the pulse generator in the area of the motor or gear input shaft is constant for one or several full revolutions of the motor, and the rigid coupling between the drive and the drum for one or several full revolutions of the drum is independent of the speed of the rpm regulable drive, while the pulses for one or more revolutions of the raceways covered by the same pulse generator are larger by their portion of relative movement.

In a development according to the present invention, the pulses originating from the pulse generator in the area of the motor or gear input shaft are put into counters which are started or stopped by each impulse respectively multiple of it, originating from the raceways and the number of the pulses between one or several start/stop pulses of the raceway can be compared with the one or the several predetermined values for the revolving drum.

With the help of an electronic circuit one can calculate the relative movement from the pulse difference and this can either be recorded and written down digitally or analogously.

In the case of dropping below a predetermined border value for the relative movement an acoustic or optical alarm can be operated, and a blower for cooling the furnace jacket or an arrangement for the lubrication of the tubular jacket below the raceways put into operation.

The process according to the present invention has the decisive advantage that it is possible to operate continuously with optimal play between the raceways and the revolving drum and thus to increase considerably the durability of the fire-resistant brick lining of the revolving drum.

Furthermore the system may have a calculator for the recalculation of the difference of pulses to the relative speed.

In a further advantageous development of the apparatus according to the invention, the pulse generators on the raceways can be watercooled in the case of inside fired revolving drums.

The measuring arrangement according to the present invention is distinguished by its simple development and its great safety of operation. Since no wear occurs, continuous maintenance operations are not required.

DESCRIPTION OF THE PREFERRED EMBODIMENT

Figure 1:
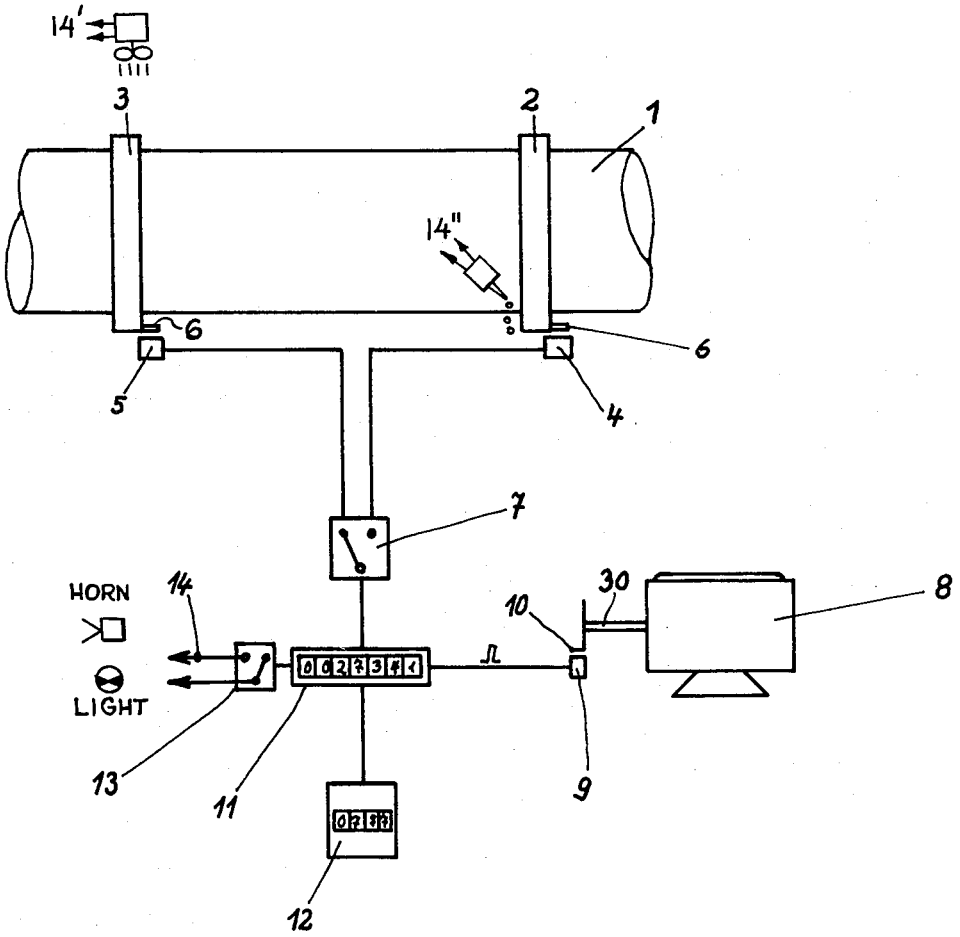
FIG. 1 is a schematic diagram showing an arrangement for the measurement of the relative movement between two raceways and a revolving drum mounted in the raceways, whereby both raceways are put on a counter.

According to FIG. 1, the measuring arrangement consists essentially of a pulse emission in the area between the motor and the gear input shaft, a pulse emission per raceway and an electronic unit.

A revolving drum 1 is mounted rotatably in several raceways, for example, in the two raceways 2 and 3. A contactless pulse generator 4 and 5 is always assigned to the raceways 2 and 3, whereby a marking flag 6 in each case rotates with the raceways 2 and 3. The pulses originating from the raceways are fed into a starter/stopper 7, which at the same time causes a continuous switchover from one raceway to the other. The pulses originating from one raceway will start and stop the counter 11.

In the area between the motor and the gear input shaft 30, the driving motor 8 for the revolving drum 1 likewise has a contactless pulse generating unit 9, 10 whereby the pulses originating from the motor shaft are fed into the counter 11 and are added there. Thus, the number of pulses is constant for one or several motor revolutions, and because of the rigid coupling between drive and revolving drum, is constant for one or more full revolutions of the drum and is independent of the speed of the drive that is regulable by the number of revolutions.

The pulses originating from the raceways 2, 3 start and stop the counter 11 sequentially in succession depending on one or several full revolutions of the raceway. Whenever the counter 11 indicates a larger number than would correspond to a full revolution of the drum, whereby this value is predetermined, relative movement between the raceways and the revolving drum exists. The difference between the indicated counter value and the number of pulses constant for one revolution of the drum, multiplied with the periphery of the drum and divided by the predetermined, already mentioned constant number of pulses, produces the relative movement.

The pulse values can now be fed into a calculator, where the described algorithm for the relative movement is calculated, and the relative movement then issued again by way of a printer 12. It is also possible to form the algorithm directly in an electronic circuit, and to print it out or record it by way of a digital regulating unit. Beyond that it is possible to convert the digital numerical value for the relative movement analogously and to feed it into a recorder.

An additional counter outlet of the counter 11 leads to a border value generator 13 which when dropping below a fixed predetermined border value of the relative movement triggers an alarm which is conducted via the line 14 to the corresponding alarm arrangement. For example, a ventilator for the cooling of a furnace jacket or of the raceway or an arrangement for the lubrication of the tubular jacket below the raceways, can be put in operation via the line 14.

Figure 2:
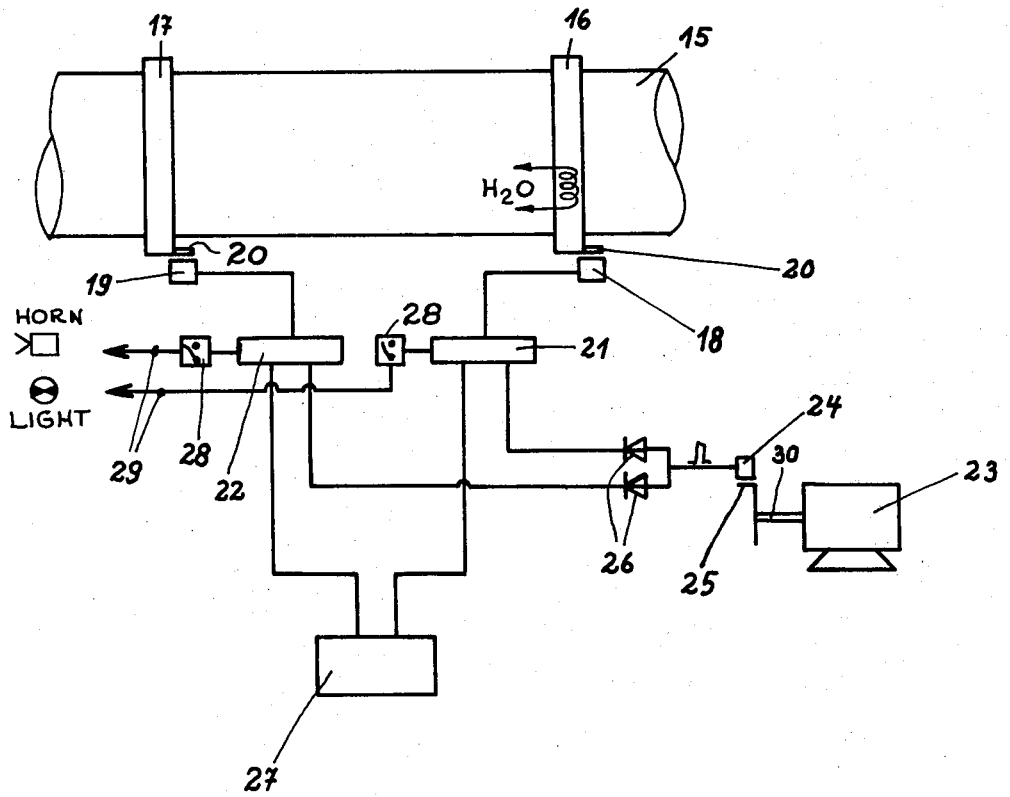
FIG. 2 is a schematic diagram of another embodiment showing an arrangement for the measurement of the relative movement according to the embodiment of FIG. 1 wherein the raceways are separately covered.

FIG. 2 shows a measuring circuit for the separate measurement of the relative movement of each raceway. A revolving drum 15 is mounted in the two raceways 16, 17 which have pulse generating units 18, 19 and 20, whereby the pulse generators 20 rotate with the raceways 16, 17. The pulse originating from the raceways 16, 17 starts and stops the counters 21, 22. Border value generators 28 are attached to the counters 21, 22 which, upon exceeding a certain border value of the relative movement, trigger an alarm via lines 29.

A driving motor 23 for the revolving drum 15 likewise has a pulse generating unit 24, 25 on its motor shaft 30, whereby the produced pulses are fed via diodes 26 to the counters 21, 22 and are added there. Otherwise, the method of operation is the same as in the embodiment of FIG. 1. The indicated difference or the already recalculated relative movement is shown in a recorder 27 and may be printed out.

In a development of the present invention, the precision of the measurement can be increased as desired by measuring several pulses per revolution of the motor or several revolutions of the drum.

I claim:

1. A control system for use with rotary kilns comprising:

at least two loose raceways;

a revolving drum mounted in said raceways;

a drive motor with gear input shaft for driving the drum at a predetermined speed;

a contactless pulse generator also driven by said drive motor for generating pulses to indicate each revolution of the motor shaft;

at least one of said loose raceways having a contactless pulse generator therewith for generating pulses corresponding to the revolutions thereof; and counter means responsive to the pulses from both the drive motor pulse generator and the at least one loose raceway pulse generator and responsive thereto for indicating the counted numbers of revolutions.

2. A control system as in claim 1, together with an electronic comparator;

said electronic comparator including means for determining the ratio of the revolutions of the at least one raceway with respect to the revolutions of the motor drive, and further includes means to compare said ratio with a predetermined value for any drum speed;

said comparator having additional means for calculating the relative movement from the difference of the aforesaid.

3. A control system as in claim 2, wherein the counter means connected with the loose raceway is equipped with a pulse generator which for each revolution of the raceway will effect a pulse for stopping and starting a counter assigned to the pulse generator for the motor so that the number of revolutions of the raceway may be determined exactly and may be compared with the defined transmission ratio of the drive motor gear input shaft to revolving drum.

4. A control system as in claim 3, together with an additional electronic calculating unit for calculating the relative movement from the difference between the ratio of revolutions per minute and the transmission ratio, and an indicating device which indicates such calculated value.

5. A control system as in claim 4, together with a border value generator which compares the calculated values of the relative movement with a permissible lower or upper value, and which upon exceeding either permissible limit value will trigger a warning signal.

6. A control system as in claim 5, together with an alarm connected to be actuated by said warning signal, and further a ventilator for actuation thereby to effect cooling of the revolving drum.

7. A control system as in claim 5, together with an alarm connected to be actuated by said warning signal, and an additional structure for actuation thereby for effecting lubrication of the loose raceways.

* * * * *